United States Patent [19]

Hertwich

[11] Patent Number: 4,664,359

[45] Date of Patent: May 12, 1987

[54] FURNACE FOR HEAT TREATING LIGHT ALLOY INGOTS

[76] Inventor: Günther Hertwich, Weinbergerstrasse 8, A-5280 Braunau, Austria

[21] Appl. No.: 788,776

[22] Filed: Oct. 18, 1985

[30] Foreign Application Priority Data

Oct. 19, 1984 [AT] Austria ..... 3335/84

[51] Int. Cl.[4] ..... C21B 9/00

[52] U.S. Cl. ..... 266/90; 266/252; 432/142

[58] Field of Search ..... 266/102, 103, 105, 249, 266/251, 252, 254, 255, 259, 287, 78, 90; 432/11, 121, 122, 134, 137, 141, 142; 148/153, 155

[56] References Cited

U.S. PATENT DOCUMENTS

| | | | |
|---|---|---|---|
| 2,711,309 | 6/1955 | Hess | 266/252 |
| 2,793,027 | 5/1957 | Matthey | 148/155 |
| 4,398,700 | 8/1983 | Thome | 266/111 |

FOREIGN PATENT DOCUMENTS

| | | | |
|---|---|---|---|
| 752031 | 5/1943 | Fed. Rep. of Germany . | |
| 33246 | 10/1979 | Japan | 432/141 |

*Primary Examiner*—Christopher W. Brody
*Attorney, Agent, or Firm*—Karl F. Ross; Herbert Dubno

[57] ABSTRACT

A furnace for heat-treating light alloy ingots comprises a heating chamber, which is flown through by hot gases and communicates with a stock inlet and with a stock outlet and contains between said stock inlet and outlet a conveyor for intermittently conveying the ingots, which lie on said conveyor and extend transversely to its direction of conveyance. The intermittent conveyor is accommodated in a heating shaft and consists of at least two juxtaposed vertical conveyor sections, which convey in mutually opposite directions and are interconnected by transfer means. A partition which divides the furnace shaft is provided between that conveyor section which is adjacent to the stock inlet and the next following conveyor section.

10 Claims, 6 Drawing Figures

FURNACE FOR HEAT TREATING LIGHT ALLOY INGOTS

FIELD OF THE INVENTION

This invention relates to a furnace for heat-treating light alloy ingots, comprising a heating chamber, which is traversed by hot gases and communicates with a stock inlet and with a stock outlet and contains between the stock inlet and outlet a conveyor for intermittently conveying the ingots, which lie on said conveyor and extend transversely to its direction of conveyance.

BACKGROUND OF THE INVENTION

Extruded sections or tubes of light alloy are usually made from round ingots, which have been made by continuous casting and must be subjected to a heat treatment that is known as homogenization and serves to eliminate heterogeneities of the as-cast structure of the ingot. The most widely used alloys are usually heat-treated at temperatures between about 560° and 580° C. The ingots which have been heated to that homogenizing temperature must be held at that temperature for the time which is required for an adequate diffusion. For that purpose the ingots may be heated in a continuous furnace. Compared with a heating of a stack of ingots in a batch-type furnace, the heating of the ingots in a continuous furnace affords the advantage that all ingots are subjected to the same heat treatment. But in that case the walking beam conveyor must comprise ingot holders in a number which is adequate for the desired throughput rate so that each ingot will not only be heated to the homogenizing temperature but will be kept at this temperature for a predetermined time, which usually amounts to several hours. With the number of ingot holders, the length of the furnace will increase as does the space which is required for the furnace so that the ratio of furnace throughput rate to furnace volume becomes undesirable. Because the beams of the walking beam conveyor are subjected mainly to bending stresses by the ingots lying thereon, these beams must be properly supported. The supports for the walking beams extend through the furnace housing in openings which must permit the supports to move in the direction of conveyance to the extent of the length of a step of the walking beam conveyor. Even though these openings may be sealed with heat-insulating material, heat losses through the openings are inevitable and may be substantial because the furnace has a substantial length.

In an attempt to reduce the length of such continuous furnaces, the heating chamber to be traversed by the ingots can be divided in the direction of conveyance into two heated compartments, i.e. a heating-up compartment and a holding compartment, in which the ingots are held at the temperature to which they have been heated. In such a divided heating chamber the ingots can be heated to the homogenizing temperature by gases at a temperature in excess of that homogenizing temperature so that the heating-up time and the length of the heating-up compartment can be substantially reduced. Nevertheless, such continuous furnaces require considerable space. For this reason it has been suggested to preheat the ingots to the required homogenizing temperature in separate continuous furnaces although this involves a substantially higher capital and structural expenditure.

The heat-treated ingots must be reheated so that they will have an adequate ductility before they can be extruded. The required reheating temperatures are about 50° to 100° C. below the homogenizing temperature. The reheating of ingots to be extruded is usually performed in separate furnaces, in which additional energy is consumed. It appears to be desirable to homogenize the ingots immediately before they are extruded so that an additional reheating to a temperature at which the ingots can be extruded will no longer be required. But a combination of a homogenizing treatment and a reheating to an extrusion temperature in a common continuous furnace is usually unpractical because the furnace would require a large space and usually there are space limitations in existing extrusion plants.

From German Pat. No. 752,031 it is known that light alloy ingots can be conveyed through a heat-treating furnace by means of a revolving vertical chain conveyor having conveying beams which are provided with members for carrying the light alloy ingots. Compared with intermittent conveyors, such chain conveyors have the substantial disadvantage that the speed of travel must necessarily be the same throughout the path of travel and during the transition from the rising course to the descending course of the chain the ingots must be lifted from the carrying members adjacent to the upper reversing sprockets and must subsequently be caught by the carrying members. Besides, in the known furnaces provided with such vertical chain conveyors all ingots contained in the heating chamber can be subjected only to a uniform temperature so that the heating chamber cannot be divided into a heating-up compartment and a holding compartment.

OBJECT OF THE INVENTION

It is an object of the invention to avoid said disadvantages and to provide for the heat treatment of light alloy ingots a furnace which is of the kind described first hereinbefore and which is improved in that the space requirements of the continuous furnace are substantially reduced, each ingot can be subjected to a specifically required heat treatment with a high efficiency, and the intermittent conveyor provided between the stock inlet and the stock outlet of the furnace does not require expensive means to cover openings in the furnace housing.

SUMMARY OF THE INVENTION

A vertical partition is provided between the oppositely moving conveyor sections of the vertical intermittent conveyor, dividing the heating shaft into two vertical flow paths. The flow paths extending on opposite sides of the partition may communicate with eachother to provide a closed path for the circulation of the hot gases. If the ingots are to be heated up rapidly and the ingots which have been heated to a homogenizing temperature in the furnace are to be held at said temperature, the flow path on that side of the partition that faces the stock inlet will be used to conduct hot gases at a temperature in excess of the temperature to which the stock is to be heated whereas the flow path on the other side of the partition may be supplied with hot gases which are merely adapted to compensate the heat losses which occur. Particularly desirable conditions are obtained using a heat-insulating position so that the heat transfer between the two flow paths will be minimized.

The hot gases required to compensate heat losses in the flow path or flow paths on that side of the partition which is opposite from the stock inlet may be branched in a simple manner from the hot gases flowing on that side of the partition which faces the stock inlet. That branch stream can be desirably controlled if the partition is formed with the flow passage openings, which are adapted to be closed by flap valves and are preferably formed in a wall portion which is vertically opposite to the means for transferring the ingots between the conveyor sections which are separated by the partition. By a control of the flap valves, the flow of hot gases used to hold the ingots at the homogenizing temperature can be controlled in dependence on the requirements.

A particularly simple design of the intermittent conveyor will be obtained if each conveyor section comprises a plurality of juxtaposed vertical shafts, which are rotatably mounted and spaced apart transversely to the longitudinal direction of the ingots and are provided with regularly axially spaced apart arms for carrying the ingots, one set of the shafts are axially displaceable to an extent which is at least equal to the axial spacing of the carrying arms. For an intermittent conveyance of the ingots, the axially displaceable shafts must be raised or lowered to the extent of one conveying step when the carrying arms have been swung out of the path of the ingots to permit a movement of the ingots and have subsequently been swung back to their carrying position the ingots can be placed on the swung-back carrying arms of the axially fixed shafts. Thereafter the carrying arms of those shafts which can be lifted and lowered are swung out of the path for the ingots and the axially displaceable shafts are subsequently returned to their initial position in which they are ready for the next conveying step. Because the arms are carried by vertical shafts, the shafts require a support only in an axial direction, and because in addition to a partial rotation of the shafts only an axial displacement of one set of the shafts is required, the openings in which the shafts extend through the furnace housing can be heat-insulated in a simple manner so that additional heat losses will be prevented.

Because the furnace in accordance with the invention requires only a small space, the furnace may be arranged close to the extruding plant so that the homogenized ingots can be extruded without being reheated. Alternatively, the furnace can be used to advantage only for reheating or only for homogenizing. When the furnace is used for homogenizing, the ingots must be cooled after they have been discharged from the furnace. Such cooling can be effected in a particularly simple manner if the furnace comprises an odd number of conveyor sections and the conveyor shaft which is adjacent to the stock outlet if followed by another vertical conveyor section extending in a cooling shaft, which is disposed outside the heating shaft. In that case the hot ingots which have been discharged from the furnace will move in the cooling shaft also in a vertical direction so that the cooler requires only a small space and the cooling air flows under favorable conditions. The sensible heat of the heated cooling air may be used, e.g. for room heating. Owing to the provision of an odd number of conveyor sections in the heating shaft and of one conveyor section in the cooling shaft there is an even total number of conveyor sections and the ingots can be conveyed before and after the furnace-cooler combination on the same level. For the function of the furnace or of the furnace-cooler combination it will make no difference whether the ingots are raised or lowered by the first conveyor section; this will generally depend on the local conditions.

SPECIFIC DESCRIPTION

Figure 1:
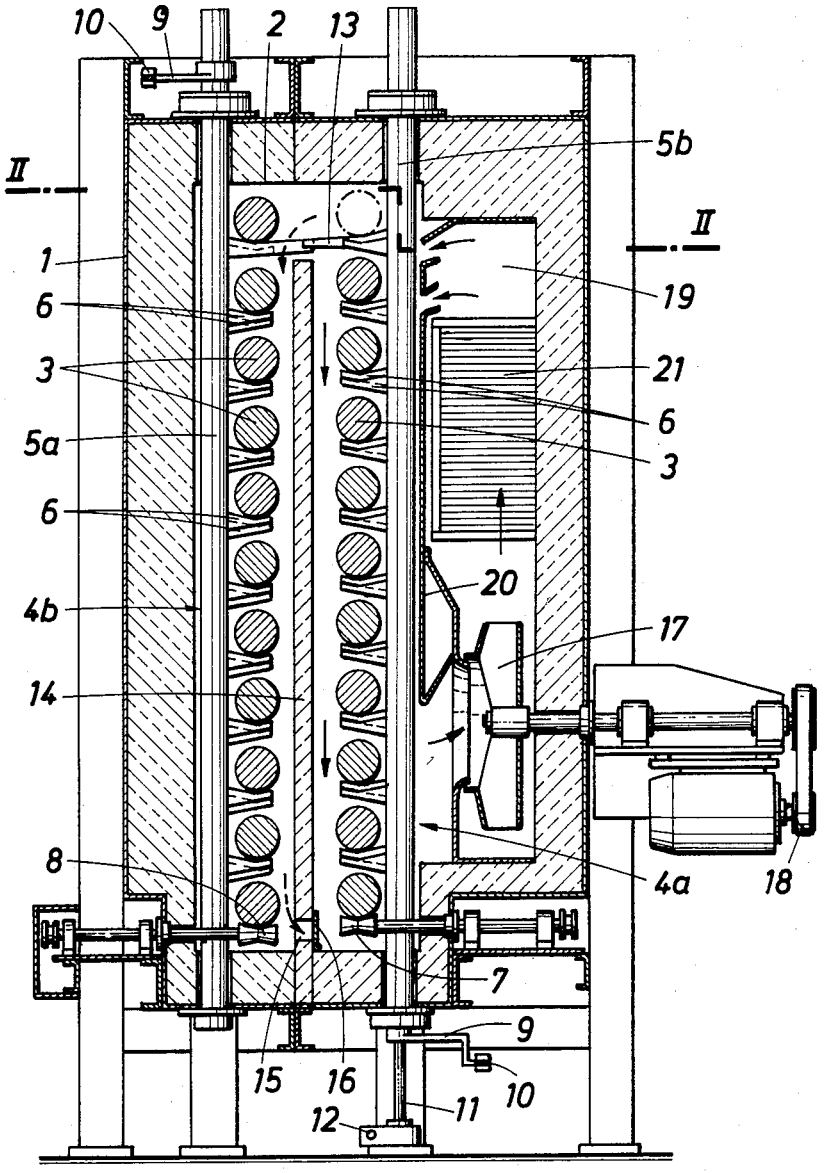
FIG. 1 is a simplified vertical sectional view showing a furnace in accordance with the invention for heat-treating light alloy bars.
Figure 2:
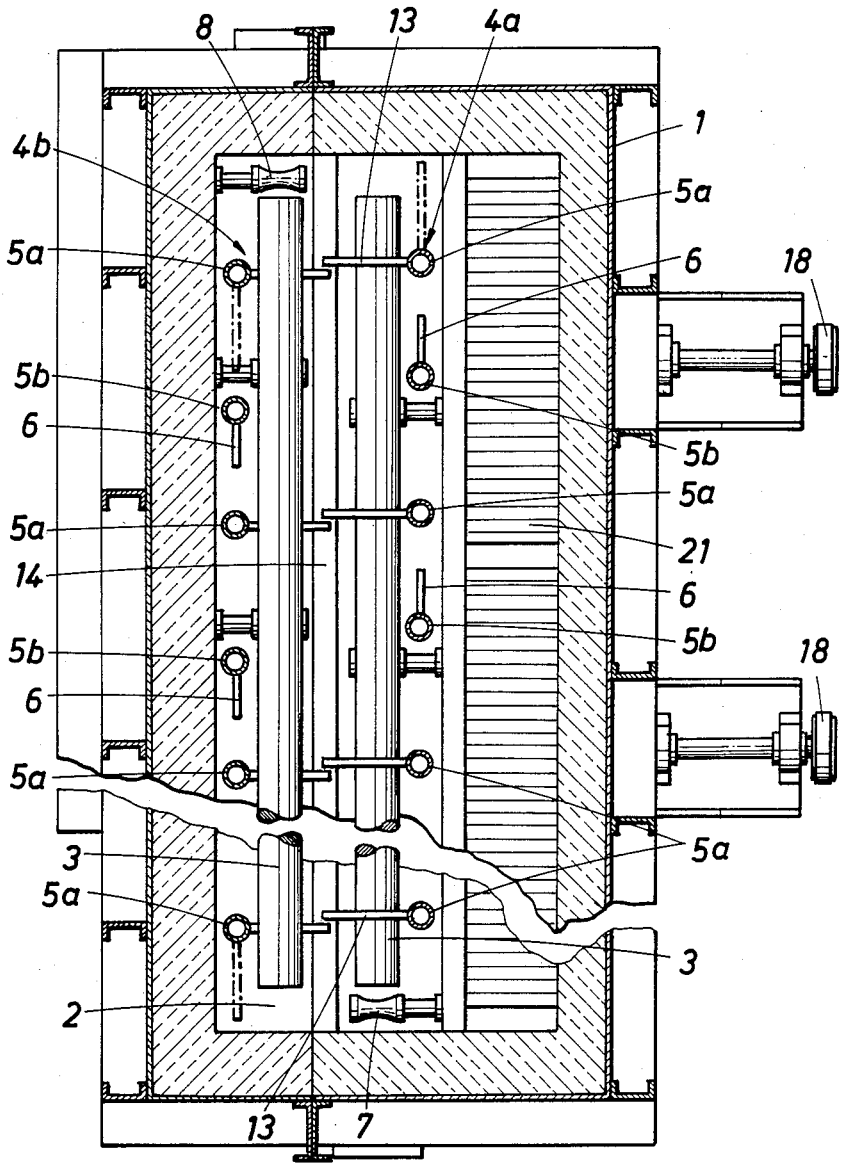
FIG. 2 is a sectional view taken on line II—II in FIG. 1.

In the embodiment of FIGS. 1 and 2 the furnace comprises an upright furnace housing 1, which encloses a heating shaft 2 and is provided with a stock inlet and a stock outlet, which communicate with the heating shaft 2 and are not shown for the sake of clearness. An intermittently operating conveyor for conveying ingots 3 extending transversely to the direction of conveyance is provided in the heating shaft between the stock inlet and the stock outlet.

The conveyor comprises two juxtaposed vertical conveyor sections 4*a* and 4*b*, each of which comprises two sets of vertical shafts 5*a* and 5*b*, which are spaced apart in the longitudinal direction of the ingots 3. The shafts 5*a* and 5*b* are rotatably mounted in the furnace housing 1 and carry regularly axially spaced apart arms 6 for carrying the ingots 3. The shafts 5*a* are mounted in the housing 1 of the furnace only for rotation. The shafts 5*b* are mounted in the furnace housing 6 rotation and for an axial displacement. By means of the arms 6 carried by the shafts 5*b*, the ingots can be moved in one conveying step to the carrying arms 6 of the axially fixed shafts 5*a*. To permit a raising or lowering of the ingots past the carrying arms 6 of the axially fixed shafts 5*a*, said shafts 5*a* must be rotated to swing their carrying arms 6 out of the path for the ingots.

When the ingots have been raised or lowered, the carrying arms of the axially fixed shafts 5*a* are returned to their initial position and the ingots 3 are subsequently redeposited on said carrying arms. Thereafter the carrying arms 6 of the displaceable shafts 5*b* are swung out of the path for the ingots and the displaceable shafts 5*b* are subsequently returned to their initial axial position and are thereafter rotated to return their carrying arms 6 to their initial position.

The axial displacements and rotations of the shafts 5*a* and 5*b* can be properly controlled in such a manner that the ingots 3 are intermittently raised or lowered. By means of driven roller conveyors 7 and 8, the ingots are moved in their longitudinal direction through the stock inlet to the intermittent conveyor and are withdrawn in their longitudinal direction through the stock outlet from the intermittent conveyor.

A partial rotation is imparted to the shafts 5*a* and 5*b* by means of turning arms 9, which are non-rotatably connected to the shafts and extend outside the furnace housing and which are interconnected by coupling rods 10 and driven by an actuator, which is not shown and may consist, e.g., of a fluid-operable cylinder, which is pivoted at one end to the furnace housing and at the other end to the coupling rods. The conveying axial movement is imparted to the shafts 5b by power screws 11. The power screws associated with each conveyor section are interconnected by a common drive shaft 12.

Ingot transfer means 13 are provided for transferring each ingot 3 from the conveyor section 4a to the conveyor section 4b. In the present embodiment, said transfer means comprise wedges, which are connected to the shafts 5a and on their downwardly inclined surfaces receive the ingots from the conveyor section 4a and permit them to roll to the succeeding conveyor section 4b, which is moved in the opposite direction.

The heating shaft 2 contains a partition 14, which extends between the two conveyor sections 4a and 4b and divides the heating shaft 2 into two flow paths. In that wall portion of the partition 14 which is vertically opposite to the transfer means 13, the partition 14 is formed with flow passage openings 15, which can be closed by means of flap valves 16.

A hot gas stream is generated by means of fans 17, which are arranged in a flow-conducting shaft 19 disposed inside the furnace housing and are driven by drive means 18 disposed outside the heating shaft 2. The flow-conducting shaft 19 is separated from the heating shaft 2 by a partition 20. The fans 17 are operable to suck air from the heating shaft 2 and to force the air through the flow-conducting shaft 19 back into the heating shaft 2 so as to effect a circulation of the air. The air which has been delivered by the fans 17 flows through an electric heating register 21, which is disposed in the flow-conducting shaft 19 and heats the air to the required temperature.

When the ingots 3 have been fed by the roller conveyor 7 through the stock inlet into the heating shaft 2, they are intermittently raised by the conveyor section 4a and are heated to a desired temperature by the hot air which flows through the heating shaft opposite to the direction of conveyance of the conveyor section 4a. Because the downwardly conveying conveyor section 4b is heat-insulated by the partition 14 from the upwardly conveying conveyor section 4a, the ingots which are being conveyed by the conveyor section 4a can be heated with hot gases which are at a temperature in excess of the temperature to which the ingots are to be heated. This permits a rapid heating-up. An overheating of the ingots need not be feared because the ingots which have been heated to the required temperature are transferred to the conveyor section 4b, in which the hot gases flow in a secondary cycle. The conditions of flow in said secondary cycle can be controlled by means of the flap valves 16 in such a manner that only the heat losses are compensated so that the ingots will be held at the temperature to which they have been heated. If the temperature of the ingots 3 is measured at the delivery end of the conveyor section 4a, the final temperature of the ingots can exactly be controlled by a control of the temperature of the hot gases.

Figure 3:
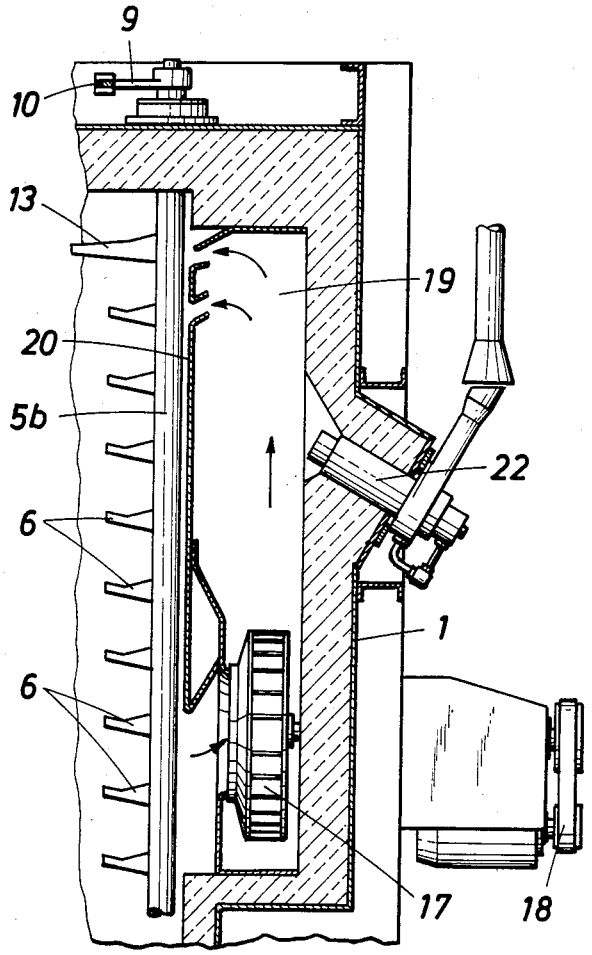
FIG. 3 is a view that is similar to FIG. 1 and shows the furnace section provided with modified gas-heating means.

It is apparent from FIG. 3 that hot gases may be produced by various kinds of heating means. In the embodiment shown in FIG. 3, burners 22 are used for that purpose and in combination with a recuperator permit a heating with a relatively high efficiency.

Figure 4:
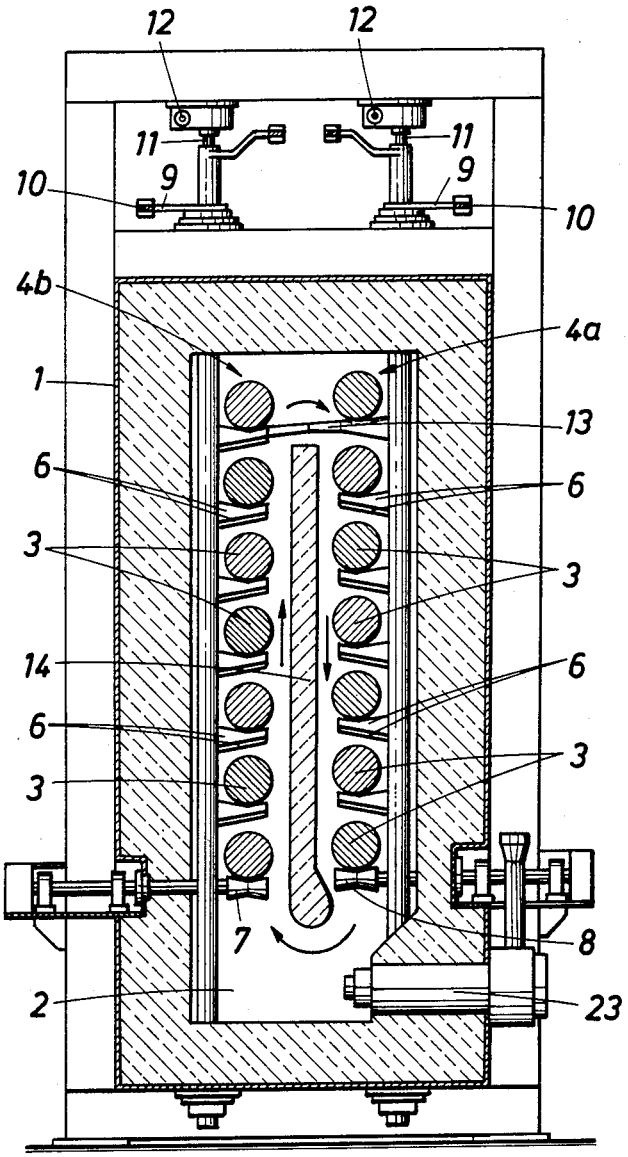
FIG. 4 is a vertical sectional view showing a modified furnace.

The furnace shown in FIG. 4 does not contain a flow-conducting shaft which is separated from the heating shaft 2 and used for the generation of hot gases. In this embodiment the heating shaft 2 is divided by the partition 14 extending between the two conveyor sections 4a and 4b into two vertical flow paths, which are interconnected for a circulation of hot gas. That hot gas is produced by a burner 23, which opens into the heating shaft near its bottom and discharges flue gases at a high velocity of flow so as to ensure a circulation of the gases.

In this embodiment the conveyor sections 4a and 4b are not heat-insulated from each other. For this reason such furnace is desirably used to heat the ingots to a desired temperature, e.g. to an extrusion temperature. Nevertheless,all advantages regarding the simple design of the conveyor sections the small space requirement and the high efficiency will be retained.

Figure 5:
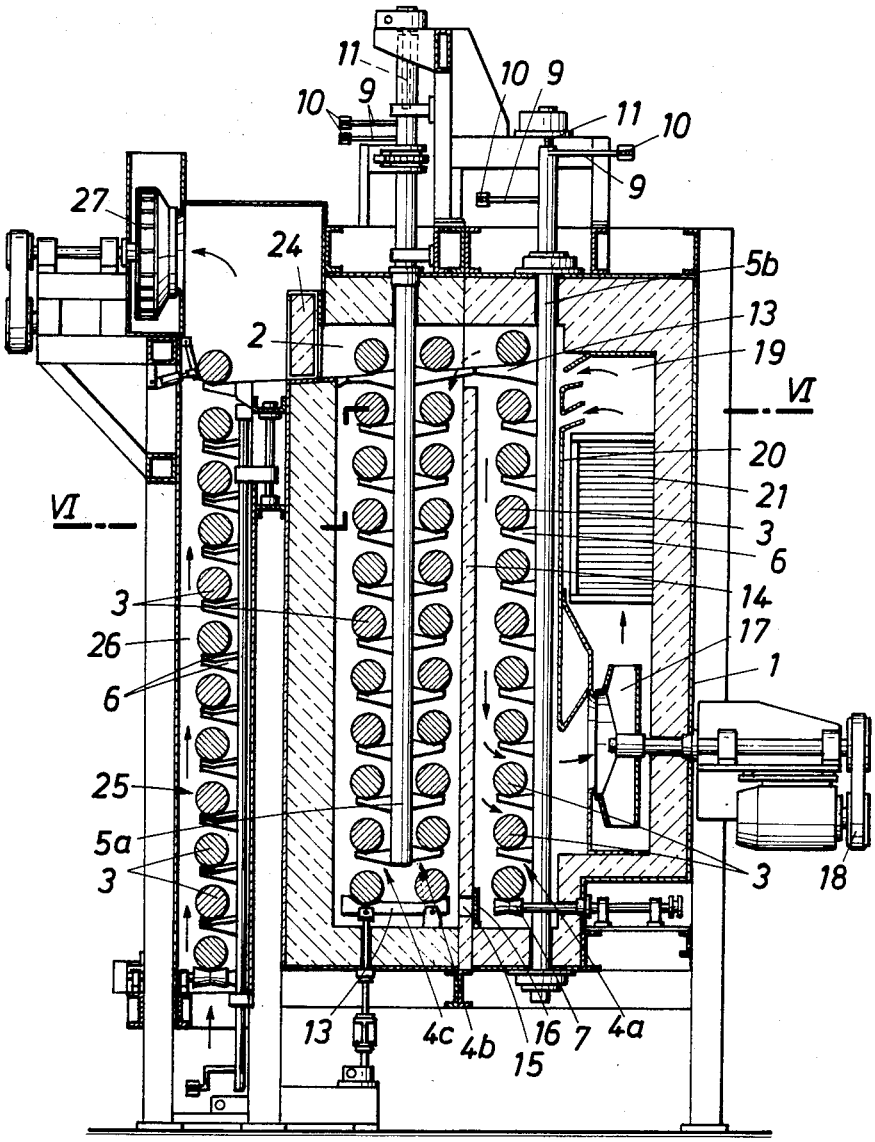
FIG. 5 is a vertical sectional view showing another modified furnace.
Figure 6:
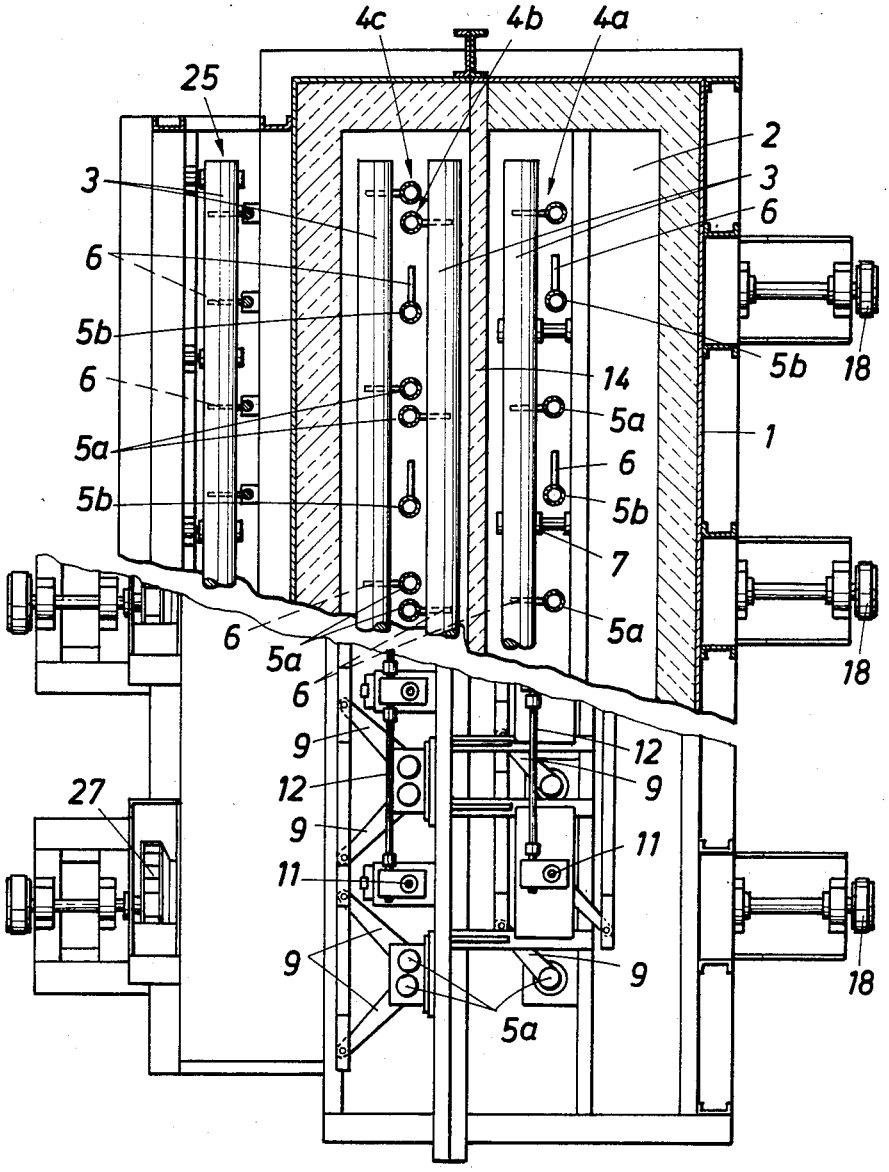
FIG. 6 is a top plan view showing the furnace of FIG. 5 partly in a sectional view taken on line VI—VI in FIG. 5.

In the embodiment shown in FIGS. 5 and 6 the intermittent conveyor provided in the heating shaft 2 comprises three vertical conveyor sections 4a, 4b and 4c. The ingots 3 are fed into the heating shaft 2 by the roller conveyor 7 and are intermittently raised by the conveyor section 4a and are heated at the same time by counterflowing hot gases, which have been forced by the fan 17 through the electric heating register 21, which is disposed in a flow-conducting shaft 19, which is separated from the heating shaft 2 by a partition 20. The heated gases leave the flow-conducting shaft 19 at its top and flow downwardly between the partition 14 and the partition 20. The ingots 3 are heated up in a relatively short time while they are conveyed by the conveyor section 4a and when they have reached the desired final temperature are transferred to the conveyor section 4b. That conveyor section 4b as well as the conveyor section 4c are provided in that compartment of the heating shaft 2 which is separated by the partition 14 from the conveyor section 4a and in which the ingots are to be held at the temperature to which they have been heated so that the diffusion can be effected which is required to eliminate heterogeneities in the as-cast structure.

The flap valves 16 can be controlled to maintain a secondary circulation of hot gas through said compartment of the heating shaft at a flow rate which is just sufficient to compensate the heat losses which occur. As two conveyor sections 4b and 4c are contained in said compartment, the ingots remain in said compartment for a relatively long time. The ingots 3 which have been heat-treated are transferred through the stock outlet 24, which is adapted to be closed to an additional conveyor section 25, which is provided in a cooling shaft 26 outside the furnace housing 1 and is designed like each of the conveyor sections 4a, 4b, 4c. In that cooling shaft 26 the ingots 3 are cooled by counterflowing cooling air. The heated cooling air is sucked off by fans 27. The sensible heat of said heated cooling can be used, e.g., for room heating.

Because an even number of conveyor sections are provided inside the heating shaft 2 and outside the same, the last conveyor section 25 delivers the ingot on the level of the stock inlet of the furnace so that there is no need for additional conveying means.

I claim:

1. A furnace for heat-treating stock in the form of elongated light alloy ingots, comprising:

a furnace structure defining an upright heating chamber adapted to receive said stock to be heat treated and to discharge the heat-treated stock;

a vertical partition in said chamber subdividing said chamber into two vertically elongated functionally distinct heating compartments;

respective conveyors in said compartments for intermittently conveying said stock upwardly in a first of said compartments, downwardly in a second of said compartments, and transferring stock between said compartments for conveying by said conveyors;

a source of hot gas connected with said chamber for heating said stock in said compartments; and means for controlling the heating of said stock in said compartments so that said stock is heated by said gas at a temperature above a predetermined heat-treatment temperature in one of said compartments, but is then maintained at said predetermined heat-treatment temperature in the other of said compartments with said partition preventing excessive heating of said stock in said other compartment by said gas at a temperature above said predetermined heat-treatment temperature.

2. The furnace defined in claim 1 wherein said partition is composed of heat-insulating material and said means for controlling the heating of said stock in said compartment includes flow passages in said partition communicating between said compartments and provided with flap valves controlling flow through said flow passages.

3. The furnace defined in claim 1 wherein said flow passages are provided in said partition in a portion thereof opposite the location at which stock is transferred between said compartments.

4. The furnace defined in claim 3 wherein said conveyors each comprise pluralities of vertically spaced fixed arms disposed in said compartments, respective rotatable shafts extending vertically in said compartments and provided with swingable arms cooperating with said fixed arms to displace said stock from fixed arm to fixed arm of the respective conveyor in succession in a vertical direction, said rotatable shafts being mounted for axial displacement in said structure.

5. The furnace defined in claim 4 wherein the shafts of said conveyors are mounted for axial displacement in opposite directions.

6. The furnace defined in claim 1 wherein said conveyors each comprise pluralities of vertically spaced fixed arms disposed in said compartments, respective rotatable shafts extending vertically in said compartments and provided with swingable arms cooperating with said fixed arms to displace said stock from fixed arm to fixed arm of the respective conveyor in succession in a vertical direction, said rotatable shafts being mounted for axial displacement in said structure.

7. The furnace defined in claim 6 wherein the shafts of said conveyors are mounted for axial displacement in opposite directions.

8. The furnace defined in claim 1 wherein an odd number of said conveyors is provided and said structure is formed with a cooling shaft provided with a respective such conveyor for receiving said stock from said other of said compartments.

9. The furnace defined in claim 8 wherein a stock inlet is provided at a lower end of said first compartment, said conveyor in said first compartment moves said stock upwardly, a stock outlet is provided substantially at the level of said stock inlet and said conveyor in said second compartment moves the stock downwardly to said outlet.

10. The furnace defined in claim 1 wherein said furnace structure is formed with a stock inlet at a lower end of said first compartment and with a stock outlet at a lower end of said second compartment, said first compartment is said one of said compartments, said second compartment is said other of said compartments, each of said conveyors include a plurality of vertically spaced horizontally extending fixed arms and swingable arms cooperating with said fixed arms on vertically displaceable rotatable shafts for transferring said stock from fixed arm to fixed arm vertically upwardly in said first compartment, and from fixed arm to fixed arm vertically downwardly in said second compartment, means being provided above said partition for transferring said stock from said conveyor in a first compartment to said conveyor in said second compartment, said partition being composed of heat-insulating material, said means for controlling the heating of said stock in said compartments including openings at a lower end of said partition provided with flap valves for controlling flow of gas through said openings, said source of heat gas communicating directly with said first compartment.

* * * * *